US011018428B2

(12) United States Patent
Kirknes

(10) Patent No.: US 11,018,428 B2
(45) Date of Patent: May 25, 2021

(54) PATCH ANTENNA FEED

(71) Applicant: Norbit ITS, Trondheim (NO)

(72) Inventor: Steffen Kirknes, Ranheim (NO)

(73) Assignee: Norbit ITS, Trondheim (NO)

( * ) Notice: Subject to any disclaimer, the term of this patent is extended or adjusted under 35 U.S.C. 154(b) by 0 days.

(21) Appl. No.: 16/487,410

(22) PCT Filed: Mar. 14, 2018

(86) PCT No.: PCT/EP2018/056337
§ 371 (c)(1),
(2) Date: Aug. 20, 2019

(87) PCT Pub. No.: WO2018/167120
PCT Pub. Date: Sep. 20, 2018

(65) Prior Publication Data

US 2020/0058998 A1 Feb. 20, 2020

(30) Foreign Application Priority Data

Mar. 15, 2017 (NO) ..... 20170411

(51) Int. Cl.
*H01Q 9/04* (2006.01)
*H01Q 5/35* (2015.01)
(Continued)

(52) U.S. Cl.
CPC ..... *H01Q 9/0457* (2013.01); *H01Q 1/2283* (2013.01); *H01Q 1/38* (2013.01); *H01Q 5/35* (2015.01)

(58) Field of Classification Search
CPC .. H01Q 9/0407; H01Q 9/0435; H01Q 9/0421; H01Q 9/045; H01Q 1/38;
(Continued)

(56) References Cited

U.S. PATENT DOCUMENTS 5,241,321 A 8/1993 Tsao
6,054,953 A 4/2000 Lindmark
(Continued)

FOREIGN PATENT DOCUMENTS

CA 2218269 A1 4/1999
CN 104103906 A 10/2014
(Continued)

OTHER PUBLICATIONS

Taddei, Ruggero, "International Search Report" for PCT/EP2018/056337, dated Jun. 13, 2018, 5 pages.
(Continued)

*Primary Examiner* — Haissa Philogene
(74) *Attorney, Agent, or Firm* — Shackelford, Bowen, McKinley & Norton, LLP

(57) ABSTRACT

Present teachings relate to an antenna arrangement comprising, a first substrate comprising a first surface and a second surface, the first surface and the second surface being opposite sides of the first substrate, a second substrate comprising a third surface and a fourth surface, the third surface and the fourth surface being opposite sides of the second substrate, a patch antenna being realized in a first electrically conductive material attached to the first surface, a ground plane being realized in a second electrically conductive material attached to the second surface, and at least two feeds realized in a third electrically conductive material attached at least partially to the fourth surface. The patch antenna is arranged with respect to the ground plane so as to form a resonant antenna. The first substrate and the second substrate are adapted to be held in close proximity or in contact such that the third surface is facing the second surface, and each of said at least two feeds are having an individual corresponding opening in the ground plane for capacitively coupling each of said at least two feeds to the
(Continued)

patch antenna, wherein footprint of each of said at least two feeds is smaller than footprint of its corresponding opening in the ground plane. Present teachings also relate to an antenna arrangement where the second substrate is replaced by a dielectric layer, and to a wireless device comprising the antenna arrangement.

16 Claims, 5 Drawing Sheets

(51) Int. Cl.
*H01Q 1/22* (2006.01)
*H01Q 1/38* (2006.01)

(58) Field of Classification Search
CPC ..... H01Q 1/48; H01Q 1/2283; H01Q 5/35; H01Q 13/08; H01Q 13/10; H01Q 19/005; H01Q 21/065
See application file for complete search history.

(56) References Cited

U.S. PATENT DOCUMENTS

| | | | | |
|---|---|---|---|---|
| 6,903,687 | B1 * | 6/2005 | Fink | H01Q 9/0407 333/126 |
| 7,091,907 | B2 | 8/2006 | Brachat | |
| 8,542,151 | B2 * | 9/2013 | Lin | H01Q 9/045 343/700 MS |
| 8,619,003 | B2 * | 12/2013 | Dairiki | H01Q 13/10 343/893 |
| 10,651,138 | B2 * | 5/2020 | Kirino | G01S 13/931 |
| 2003/0076259 | A1 | 4/2003 | Zhang | |
| 2004/0113840 | A1 | 6/2004 | Gottwald et al. | |
| 2005/0052321 | A1 | 3/2005 | Lee et al. | |
| 2007/0080864 | A1 | 4/2007 | Channabasappa | |
| 2009/0015483 | A1 | 1/2009 | Liu | |
| 2009/0256752 | A1 | 10/2009 | Akkermans et al. | |
| 2016/0261036 | A1 * | 9/2016 | Sato | G01S 7/4026 |
| 2016/0261039 | A1 | 9/2016 | Parsche | |
| 2017/0093041 | A1 | 3/2017 | McMichael | |
| 2018/0337456 | A1 | 11/2018 | Liu et al. | |
| 2020/0021017 | A1 * | 1/2020 | Kirknes | H01Q 23/00 |
| 2020/0161766 | A1 * | 5/2020 | Liu | H01L 23/66 |

FOREIGN PATENT DOCUMENTS

| | | | |
|---|---|---|---|
| CN | 105552550 | A | 5/2016 |
| EP | 0957535 | A1 | 11/1999 |
| EP | 1160917 | A1 | 12/2001 |
| JP | H05-145327 | A | 6/1993 |
| KR | 101014352 | B1 | 2/2011 |
| WO | WO-2012095358 | A1 | 7/2012 |

OTHER PUBLICATIONS

Singhal, Pallavi, et al.; "Rectangular Microstrip Patch Antenna Design at 3 GHz Using Probe Feed"; International Journal of Emerging Technology and Advanced Engineering, vol. 3, No. 11; Nov. 2013; pp. 421-425.

Sotelo Bazan, Gustavo Adolfo; "Design of a Circularly Polarized Patch Antenna for Satellite Mobile Communications in L-Band"; http://hdl.handle.net/2099.1/11708; University Politècnica de Catalunya; Dec. 2010; 151 pages.

Dastkhosh, Amir Reza, et al.; "A Wideband High-Gain Dual-Polarized Slot Array Patch Antenna for WiMAX Applications in 5.8 GHz"; International Journal of Antennas and Propagation, vol. 2012, Article Id 595290; Sep. 20, 2011; 6 pages.

* cited by examiner

PATCH ANTENNA FEED

BACKGROUND

The present teachings relate generally to antennas. More specifically, the present teachings relate to patch antennas for receiving and/or transmitting an electromagnetic signal preferably in microwave range.

Radio frequency ("RF") units such as transponders usually include a patch antenna. A patch antenna primarily consists of a flat sheet of metal, called a patch, arranged in such a way as to be electrically resonant over a larger sheet of metal, called a ground plane.

The antenna may be scaled to a physically smaller size by adding dielectric between the patch and the ground plane. As an example, a GPS patch antenna (L/2=190 mm) can fit onto a 25×25 mm substrate with a dielectric constant of 20.

In many applications it is desirable to have well-defined antenna characteristics. It may hence be desirable to have a well-defined medium between the patch antenna and the ground plane. Such antennas typically become narrow-banded and thus the thickness and properties of the dielectric become important for maintaining the antenna resonant frequency. One way to do so is to use a substrate with well-defined electrical properties. In this case the patch can be realized on one side of the substrate and the ground plane realized on the opposite side of the substrate.

In master thesis "*Design of a circularly polarized patch antenna for satellite communications in L-band*" by G. A. Soleto Bazán (URI: http://hdl.handle.net/2099.1/11708) several types of Microstrip antennas ("MAS") and different excitation techniques, or feeds, for such antennas were discussed.

A disadvantage of probe or coaxial type feed is that it usually requires a conductor traversing through the thickness of the substrate, for example, by drilling.

An aperture coupled feed can be an alternative to a probe feed especially when conductive electrical connection with the patch is not feasible or not desired, however a disadvantage can be that the slot type apertures require space or substrate area. As substrates with well defined electrical or microwave properties are usually expensive, it is desirable to reduce their size or area as much as possible. In addition, the aperture slots cause discontinuities in the ground plane surface. The problem is further aggravated when multiple feeds, such as dual-orthogonal feeds, are desired, for example, for achieving circular polarization of the patch antenna.

SUMMARY

According to an object of the present teachings a patch antenna arrangement with well-defined electrical properties can be provided.

According to further an object of the present teachings a patch antenna arrangement that can reduce the substrate area used by the feed can be provided.

According to another object of the present teachings a patch antenna arrangement that reduces intrusions in the ground plane due to feed can be provided.

The present teachings will now be discussed more in detail using the following drawings illustrating the aspects of invention by way of examples. The figures are not necessarily drawn to scale.

DETAILED DESCRIPTION

Figure 1A:
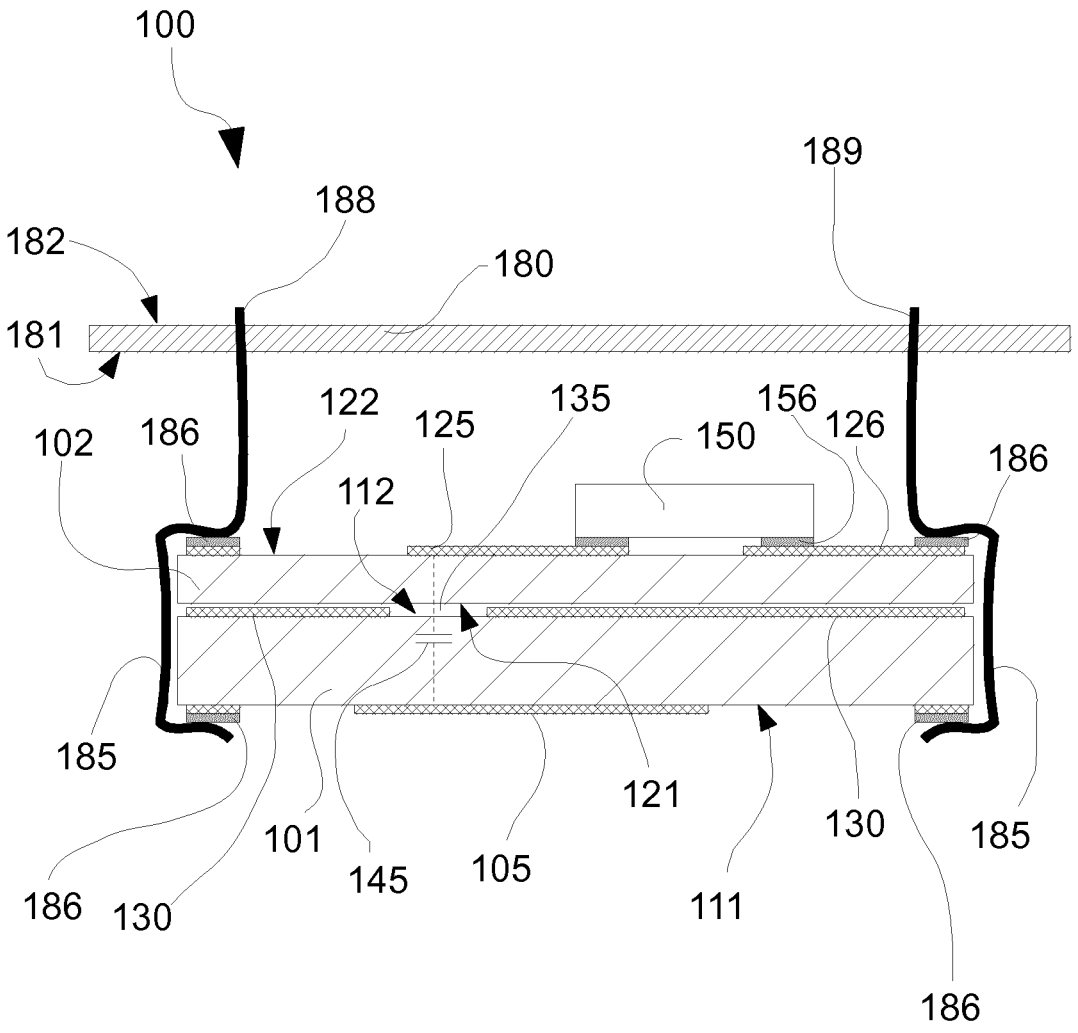
FIG. 1A illustrates a first aspect of the present teachings showing a patch antenna arrangement when realized in a sandwich type configuration with two microwave substrates.

FIG. 1A shows a side view of a patch antenna arrangement 100, showing a first aspect of the present teachings. The patch antenna arrangement 100 comprises a first substrate 101 and a second substrate 102. On a first surface 111 of the first substrate 101 a patch antenna 105 is realized, for example by a thick film process. The patch antenna 105 is realized in a conductive material, usually comprising a metal, for example silver or gold. On the first surface 111, other profiles can also be seen realized in the same conductive layer as the layer in which the patch antenna 105 is realized. These other profiles are shown stacked with connection points such as solder bumps 186. A function of these other profiles will be explained later.

On a second surface 112, on the opposite side of the first substrate 101, a ground plane 130 is realized, also in a conductive layer. The material of the conductive layer in which the ground plane 130 is realized may be same as the material in which the patch antenna 105 is realized, but it can also be a different material. The patch antenna 105 and the ground plane 130 are however conductively isolated from each other. The ground plane 130 has an opening 135 where the conductive layer is absent, hence some portion of the second surface 112 is exposed due to the opening 135.

The patch antenna arrangement 100 also comprises a second substrate 102. A third surface 121, or a side of the second substrate 102, directly faces the second surface 112. The figure shows a small gap between the surface of the ground plane 130 and the third surface 121, however these surfaces could even be in contact. As the second substrate 102 is conductively isolating, such contact is not detrimental to the desired electrical properties. A small air-gap will modify the effective dielectric constant for the feeding circuit, and may introduce a minor change in electrical parameters such as microstrip impedance, whereas the properties of the patch antenna are nearly maintained.

On a fourth surface 122, or the opposite side of the second substrate 102, conductive tracks, for example for mounting circuitry are placed. For example, one side of an SMD component 150 is shown soldered with a solder bump 156 to a first conductive track 126 attached on the fourth surface 122. The other side of the SMD component 150 is shown soldered to a conductive track connected to a capacitive feed 125. As can be seen, the capacitive feed 125 is formed at an end portion of the conductive track, on the other end of which track the SMD component 150 is shown soldered. The conductive track is shown as a metal layer in the figure, but it can also be a wire or any other type of connecting means connecting the end portion 125 to the component 150. The capacitive feed 125 or the end portion has a capacitive coupling 145 with the patch antenna 105. The capacitive coupling 145 is essentially proportional to the visible overlap area between the capacitive feed 125 and the patch antenna 105. By visible overlap area, it is meant the area of overlap between the capacitive feed layer 125 and the patch antenna layer 105 within the area of the opening 135 in the ground plane 130. A person skilled in the art understands what is meant by the overlap area in context of a capacitance. The capacitive coupling is essentially inversely proportional to the spacing between the overlapping portion of the feed layer 125 and the overlapping portion of the patch antenna 105. The spacing between the overlapping layers will essentially be the sum of thicknesses of the first substrate 101 and the second substrate 102 respectively. In reality, the thickness will also include any gap between the first substrate 101 and the second substrate 102, more specifically the distance between the second surface 112 and the third surface 121, which includes the thickness of the ground plane layer 130, however since the conductive layers are usually appreciably thinner as compared to the thickness of a substrate, the latter is dominant in deciding the capacitance value. In addition, the capacitive coupling 145 is also dependent on the medium sandwiched between the overlapping portion of the feed layer 125 and the patch antenna layer 105. More specifically, the coupling 145 is dependent on the resultant dielectric constant between the overlap area. In this case it will include contributions to the resultant dielectric constant by the first substrate 101 and the second substrate 102. In reality, there will also be contribution by the gap 135 (typically air), but in most cases the dielectric constants of the substrate materials will be dominant.

The first substrate 101 and the second substrate 102 are preferably microwave substrates. The substrates 101 and 102 could be made from the same material, or from different microwave suitable materials. The substrates are preferably made of alumina, but can also be made of quartz or other ceramics. The relative dielectric constant of the substrate materials is preferably larger than 3. More preferably, the relative dielectric constant is greater than 6. In another embodiment, the relative dielectric constant is around 20. The second substrate 102 is shown with a smaller thickness than the first substrate, however it may not always be the case. Arrangement as shown can be used for example, for reducing the distance between the feed 125 and the patch 105. This will also make the substrate sandwich thinner, however, both substrates 101 and 102 may even have similar thickness. The thicknesses are selected according to the antenna parameters desired. Substrate thicknesses readily available may be another parameter in deciding the other design parameters, for example to prevent requiring custom made substrate thickness(es), which may have impact on the price. The first substrate thickness can for example, be around 1 mm and the second substrate thickness around 0.63 mm. A skilled person will understand that thickness of the first substrate is chosen according to the antenna design. A thinner substrate means narrower bandwidth of the antenna and vice-versa. The thickness can hence be selected as suitable for antenna characteristics, such as bandwidth requirements.

Also on the fourth surface 122, additional other conductive profiles can be seen stacked with connection points shown as solder bumps 186. Said other conductive profiles can be used for at least resiliently clamping the first substrate 101 to the second substrate 102. For example, as shown, conductive wires 185 are soldered to these other profiles by using solder bumps 186. At least some of the conductive wires 185 can also be used for making electrical connection to a PCB or motherboard 180. For example, some of the conductive wires 185 may be used to transferring low-frequency or baseband signals between the electronics 150 on the microwave substrates and the motherboard 180.

The motherboard 180 can be a single layer PCB or a multi-layer PCB. Another advantage of the present teachings can be that the circuitry that does not require placement on a special substrate can be placed on the PCB 180. Usually the per area cost of the PCB 180 is lower than the per area cost of the substrates 101 or 102, such that non-critical circuitry can be placed on the PCB 180 to reduce the overall area of the substrates 101 and 102. Substrate critical circuitry such as microwave circuitry can for example be placed on the fourth surface 122. Some of the aspects that allow tighter density of components on the fourth surface 122 will be apparent in the following figures.

In an alternative way (not directly shown in figures here), the second substrate may be replaced by a dielectric layer deposited on top of the ground plane layer 130 on the second surface 112. Such a dielectric layer typically has a thickness of 35 um, but it may have other thicknesses according to the fabrication process chosen. The fabrication process is commonly a hybrid process, but other processes may be chosen according to requirements. The dielectric layer is typically deposited as a dielectric composition that produces in a hermetic film or layer when the substrate(s) is(are) fired. The dielectric composition, which is usually screen printed on the substrate, typically comprises suitable ceramic and glass compounds. Tracks such as those for forming the capacitive coupling feed 125, and for mounting circuitry such as one or more components 150, tracks 126, other printable/depositable/lithographically generated components, etc. may be placed as another metal layer on top of the dielectric layer. The dielectric layer and the another metal layer may also be deposited or printed using a thick-film process. A disadvantage of this alternative embodiment could be that at least one additional processing step is required on the first substrate 101 as compared to an embodiment with two substrates, for example that shown in FIG. 1A. A skilled person will understand that such additional dielectric layer method may also be used in addition to the two substrate configuration discussed above, for example for saving routing area, and/or for creating additional conductive features that need to be isolated from the conductive layer(s) underneath. The two aspects presented above are hence not exclusive of each other, rather combinable with each other according to requirements.

Figure 1B:
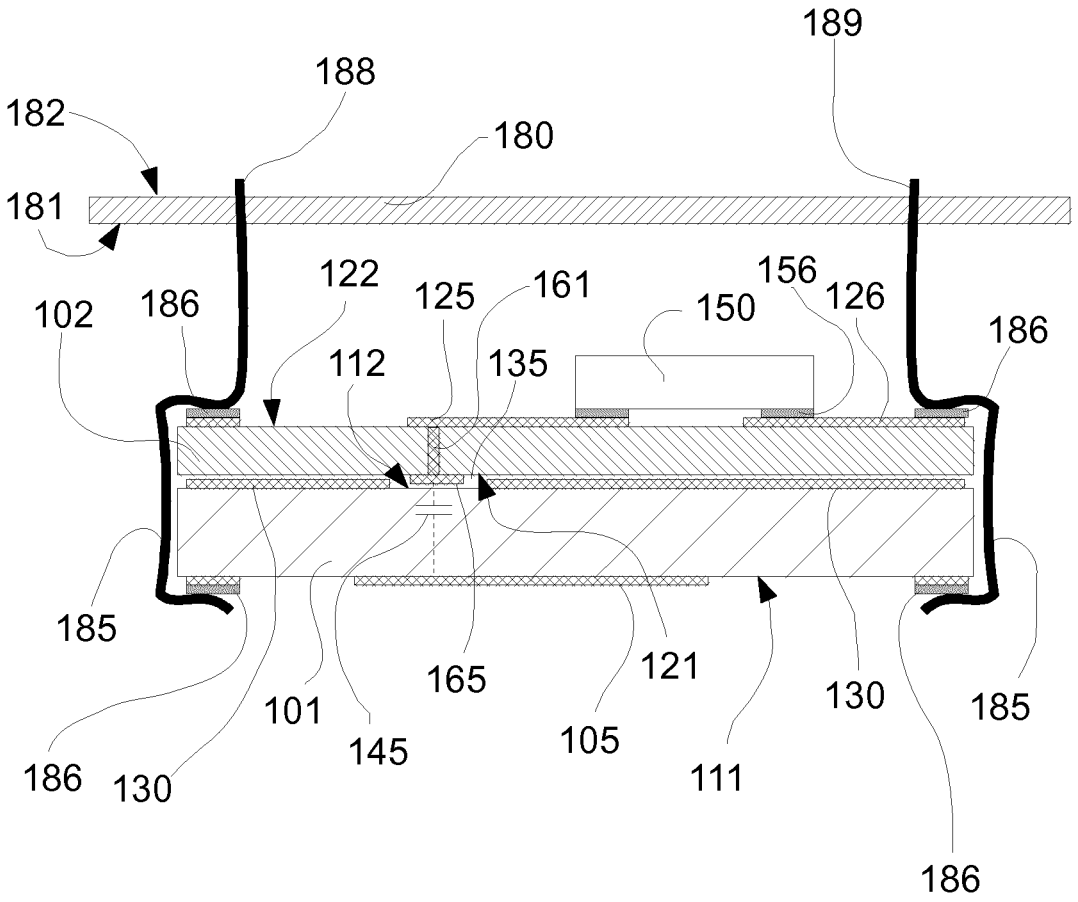
FIG. 1B illustrates another of the proposed patch antenna arrangement when realized in a sandwich type configuration with the second substrate being a non-microwave substrate.

FIG. 1B shows further a variation also comprising two substrates, however in this case, the second substrate 102 is shown as a cheaper variant rather than being a microwave substrate. Such cheaper variants may include low-cost PCBs such as FR4 type or other low-cost glass-reinforced epoxy laminates or general purpose PCBs. Microwave substrates are usually high-Q or high Q-factor substrates. By replacing the second substrate 102 with a cheaper PCB or low Q-factor substrate, further costs may be saved, especially if the circuitry, e.g., components 150 that are placed on the fourth surface do not require a microwave substrate, or in applications where any reduced performance due to these components being placed on a low-Q substrate or PCB. Processing of cheaper PCBs is generally also cheaper and easier, thus in this case the second substrate 102 may even be drilled to make a via 161. Since such processing is easier with cheaper PCBs rather than with substrates made of ceramics, glass, or such hard to process materials, in cases where the second substrate 102 is easier to process or machine, the via 161 can be used to realize a capacitive coupling pad 165 on the third surface 121. As shown in FIG. 1B, the via 161 leads/connects to a capacitive coupling pad 165 attached to the third surface 121 thereby establishing a conductive connection between the end portion 125 and the pad 165. It will be appreciated that the via need not be connected directly to the end portion 125, rather it could be connected at any other place on the conductive path spanning between the end portion 125 and the component 150. An electrical connection between the end portion 125 and the pad 165 will still exist even in such case. It is to be noted that this arrangement with the capacitive coupling pad 165 on the third surface 121 is not exclusive to the case when the second substrate 102 is a general purpose PCB. What is implied above is that such realization can be difficult with a hard materials such as ceramic, albeit not impossible. Furthermore, it will be appreciated that placing the capacitive coupling pad 165 on the third surface 121 of a microwave type second substrate will, in addition to the via 161, require realization of conductive layer also on the third surface which can make such a realization as shown in FIG. 1B expensive with a microwave type second substrate.

As will be appreciated in this case, as shown in FIG. 1B, the capacitive coupling 145 occurs primarily between the pad 165 and the patch antenna 105. As it will be noticed, the part of the end portion or feed layer 125 which, if extending beyond the periphery of the capacitive coupling pad 165, as shown here, may also be visibly overlapping with the patch layer 105, and accordingly such overlap will also contribute to the capacitive coupling 145, however the direct coupling between the area of the pad 165 overlapping with the patch 105 will dominate the value of the capacitive coupling 145.

A short circuit between the pad 165 and the ground plane 130 may be avoided, for example, by making the periphery of the pad 165 slightly smaller as compared to the periphery of the opening 135. As will be understood, while dimensioning the opening 135 with respect to the pad 165, it can be prudent to take into account the alignment tolerances between the first substrate 101 and the second substrate 102, for example, to prevent an undesired connection between the ground plane 130 and the pad 165. Alternatively, or in combination, a thin dielectric layer may be placed between the first substrate 101 and the second substrate 102 before sandwiching them, for isolating the pad 165 from the ground plane 130. This may be advantageous, for example, if the periphery of the opening 135 needs to be kept smallest possible for example, for minimizing intrusions in the ground plane 130. In this case, the periphery of the pad 165 may even be larger than that of the opening 135, without these being shorted as the thin dielectric layer will be isolating. In this case however, the overall thickness of the arrangement may slightly increase, the increase corresponding to the thickness of the thin dielectric layer and possibly further due to the third surface 121 not resting against the ground plane 130. In this embodiment, the second substrate 102 may even be made larger than the first substrate such that an additional PCB or motherboard 180 is avoided. The second substrate 102 may even be made as a multilayered PCB. In cases where a separate PCB 180 is required anyway, the second substrate 102 may still be made larger than the first substrate 101. In this case, the clamps 185 may for example, be soldered either on the third surface 121, or the fourth surface 122 using through holes in the second substrate 102, or even be soldered on both the third surface 121 and also on the fourth surface 122 using through holes in the second substrate 102. In another embodiment, the second substrate 102 may even be a flexible PCB. A skilled person will understand that a similar embodiment with the second substrate 102 replaced by a dielectric layer, for example as discussed previously, deposited on top of the ground plane 130 is possible here as well, although in this case since the dielectric layer is deposited upon the first substrate 101, the size of the dielectric layer remains within the periphery of the first substrate 101.

In further a variation (not shown in figures), instead of being realized on the third surface 121, the capacitive coupling pad 165 may be realized on the second surface 112, in the same layer as the ground plane 130. In this case, the coupling pad 165 is surrounded by the ground plane 130, but the pad 165 still conductively isolated from the ground plane 130, for example by a trench between the ground plane and the coupling pad 165. In such a case, the end of the via 161 that extends towards the third surface 121 can be provided with a solder bump or other resilient connecting means that establishes a conductive connection between the pad 165 and the via 161 once the antenna arrangement is assembled. Other resilient means can be a spring based mechanism, conductive foam, or such. In case when using solder bumps, the antenna may be assembled, for example by providing heat to the solder bump connected to the via 161 whilst the solder bump is held in contact with the pad 165 such that the solder bump melts and establishes a soldered connection between the pad 165 and the via 161. This variation is discussed in context of the arrangement equivalent to that shown in FIG. 1B, however the skilled person will appreciate that more generally, the essence is that the pad 165 need not be attached to the second substrate, rather, as described here, it may be attached to the first substrate, either directly to the second surface, or to another dielectric surface deposited on the second surface. An advantage of realizing the pad 165 on the first substrate is that an improved robustness against misalignment between the first substrate and the second substrate can be achieved. As will be appreciated, the end portion 125, and via 161, in such cases can be made smaller than the footprint of the pad 165, as capacitive coupling is dominated and mainly decided by the dimensions of the pad 165, such that the assembly of the two substrates could be made more tolerant to misalignment as compared to the case when the pad 165 is realized on the second substrate. This is because the location of the pad 165 with respect to the ground plane 130 is fixed and not dependent on the alignment of the substrates when the pad 165 is realized in the same layer as the ground plane 130.

Figure 2:
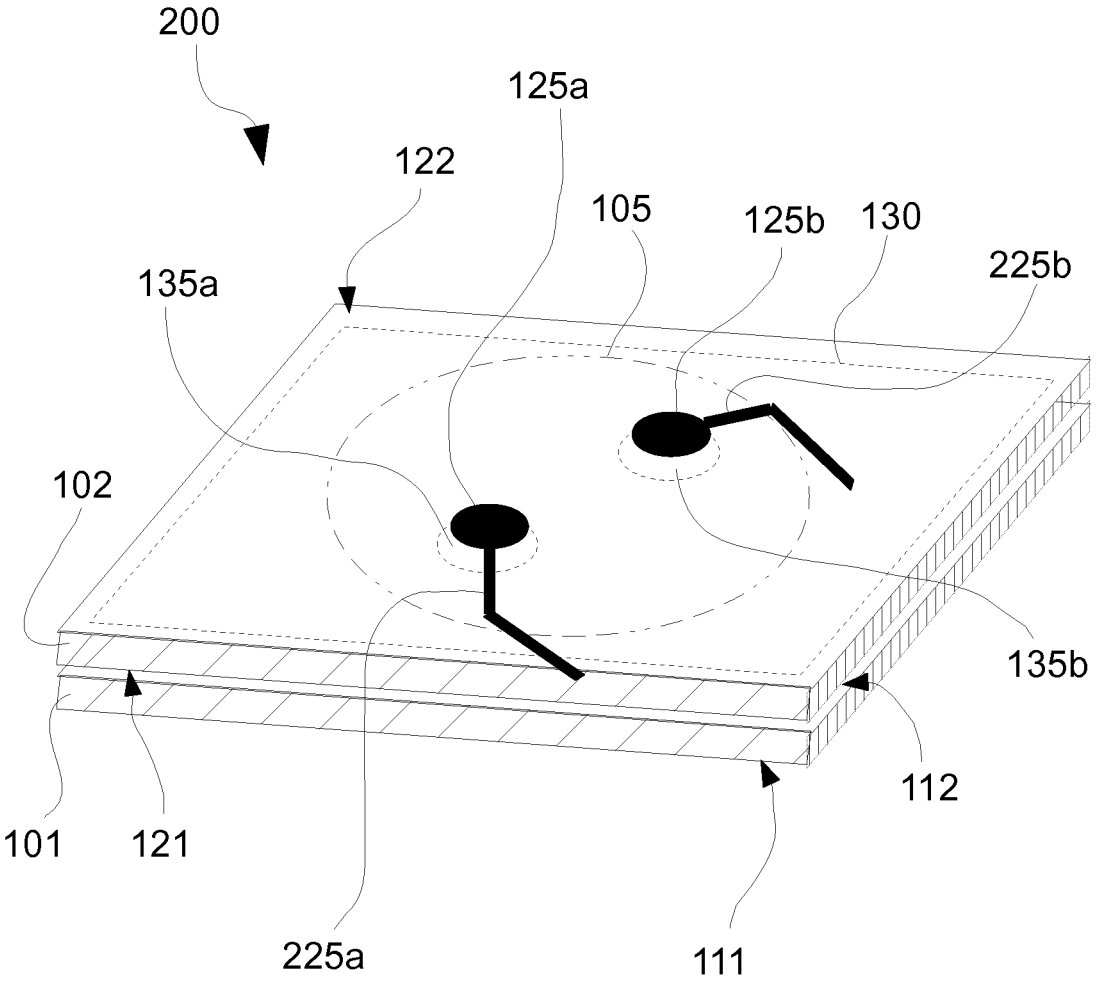
FIG. 2 illustrates an alternative zoomed-in view of the first aspect of the patch antenna arrangement showing the proposed capacitive type feeds.

Now referring to FIG. 2, that shows a zoomed-in perspective view 200 of a similar antenna arrangement as was shown in FIG. 1A. Not all components that were visible in FIG. 1A are visible here. FIG. 2 shows a perspective view from the fourth surface 122. The first substrate 101 and the second substrate 102 are shown stacked or in a sandwiched arrangement. Some portion of the ground plane 130 is shown in dotted line as the ground plane 130 is located between the second surface 112 and the third surface 121. As mentioned earlier, the ground plane is attached to first surface on the second surface 112. The first substrate 101 and the second substrate 102 can be held together as a clamping method shown in FIG. 1A, alternatively or in addition, the substrates may even be attached together by a suitable adhesive disposed between the second surface 112, possibly also covering at least some of the ground plane surface 130, and the third surface 121. The antenna arrangement 100 in FIG. 1 as shown can be considered an arrangement with a single capacitive feed or end portion 125 through the opening 135 in the ground plane 130. The opening 135 shown in FIG. 1, functionally corresponds to openings 135*a* and 135*b* in FIG. 2.

The patch antenna 105 is shown in dashed lines as it is located on the first surface 111 which is the lower most surface in FIG. 2.

The openings 135*a* and 135*b* essentially circular in profile and are used for allowing orthogonal feeding of the patch antenna 105 using the corresponding feeds or end portions 125*a* and 125*b*. The feeds, the first feed 125*a* and the second feed 125*b* are connected to their corresponding tracks, the first track 225*a* and the second track 225*b* respectively. The feeds or end portions are preferably larger than their respective tracks such that any visible overlap of the tracks with the ground plane is minimum—hence the capacitive coupling is being dominated by the end portions. The tracks 225*a* and 225*b* connect to the associated microwave circuitry (not shown in FIG. 2). The tracks 225*a* and 225*b* preferably exit radially outwards from their respective feeds 125*a* and 125*b* respectively. In other words, in a perfectly aligned case, if the axis lines (along the length) of the tracks 225*a* and 225*b* were extrapolated towards the center of the patch antenna 105, the axis lines would intersect at the center of the patch antenna 105. Even though perfect alignment is desirable, it is not essential.

It can further be stated that even though feeds 125*a* and 125*b* and their corresponding openings 135*a* and 135*b* are shown as circular in shape in FIG. 2, a circular profile is not essential. Accordingly, the profiles or shapes may be square, rectangular, pentagonal, octagonal, or essentially any suitable polygon. It is preferable though that the shape of the opening corresponds to the shape of its related feed.

Reverting to FIG. 2, the openings 135*a* and 135*b*, shown here essentially circular in profile, are spaced apart such that a continuous intrusion in the ground plane 130 is avoided. Such an intrusion will, for example, be created by a slot type opening for aperture coupling the feeds to the patch. In some variations of the slot-type apertures, the ground plane layer may even become discontinuous or divided in multiple parts. According to present teachings the continuous or long running intrusions in the ground plane as created due to e.g., slot type apertures may be avoided. Each feed or end portion is, hence, essentially enclosed within the footprint of its respective opening in the ground plane. A small portion of the respective tracks (225*a*, 225*b*) may also be overlapping through the respective opening, but it will be understood that the capacitive coupling will be dominated by the respective feed or end portion of its conductive track.

In practical manufacturing, the alignment between different layers as well as between the first substrate and the second substrate will need to have some tolerance. In other words, it is hard to manufacture a large volume of substrates or devices where each layer and/or substrates are perfectly aligned with respect to each other. As discussed previously, the capacitive coupling 145 depends upon the overlapping portion of the feed layer 125 and the patch antenna layer 105. More specifically referring to FIG. 2 now, if for example, the first feed 125*a* is misaligned with respect to its corresponding opening 135*a* such that some portion of the first feed 125*a* lies outside the periphery of the first opening 135*a*, the corresponding capacitive coupling between the first feed 125*a* and the patch antenna 105 will be affected (or reduced) as the effective overlap area is reduced. One way to ensure that the capacitive coupling is maintained is that the openings 135*a* and 135*b* can be made such that their peripheries are larger than or extend beyond the footprint of the corresponding feeds 125*a* and 125*b*. In other words, the footprints of the openings 135*a* and 135*b* are made larger than the corresponding footprint of the essentially circular feeds 125*a* and 125*b* respectively. The extension beyond the footprints can be made sufficiently large such that they take into account the alignment tolerances. In an alternative embodiment, the footprints of the feeds 125*a* and 125*b* can be made larger than, or extend beyond, their corresponding openings 135*a* and 135*b* such that the capacitive coupling is not affected within the physical alignment tolerances. A minor disadvantage of this alternative embodiment is that the extended area of the feeds will result in an additional capacitive coupling with respect to the ground plane 105, hence an additional capacitive load on the feeds. However, this additional load practically does not affect the coupling between the feed and the antenna.

In most cases it is preferable to have the ground plane 130 extending beyond the footprint of the patch antenna 105, for example to prevent back radiation. It is often desirable that the size of the ground plane 130 is twice the size of the patch 105. In reality it will also depend on how the patch 105 and the ground plane 130 are aligned with respect to each other.

Figure 3:
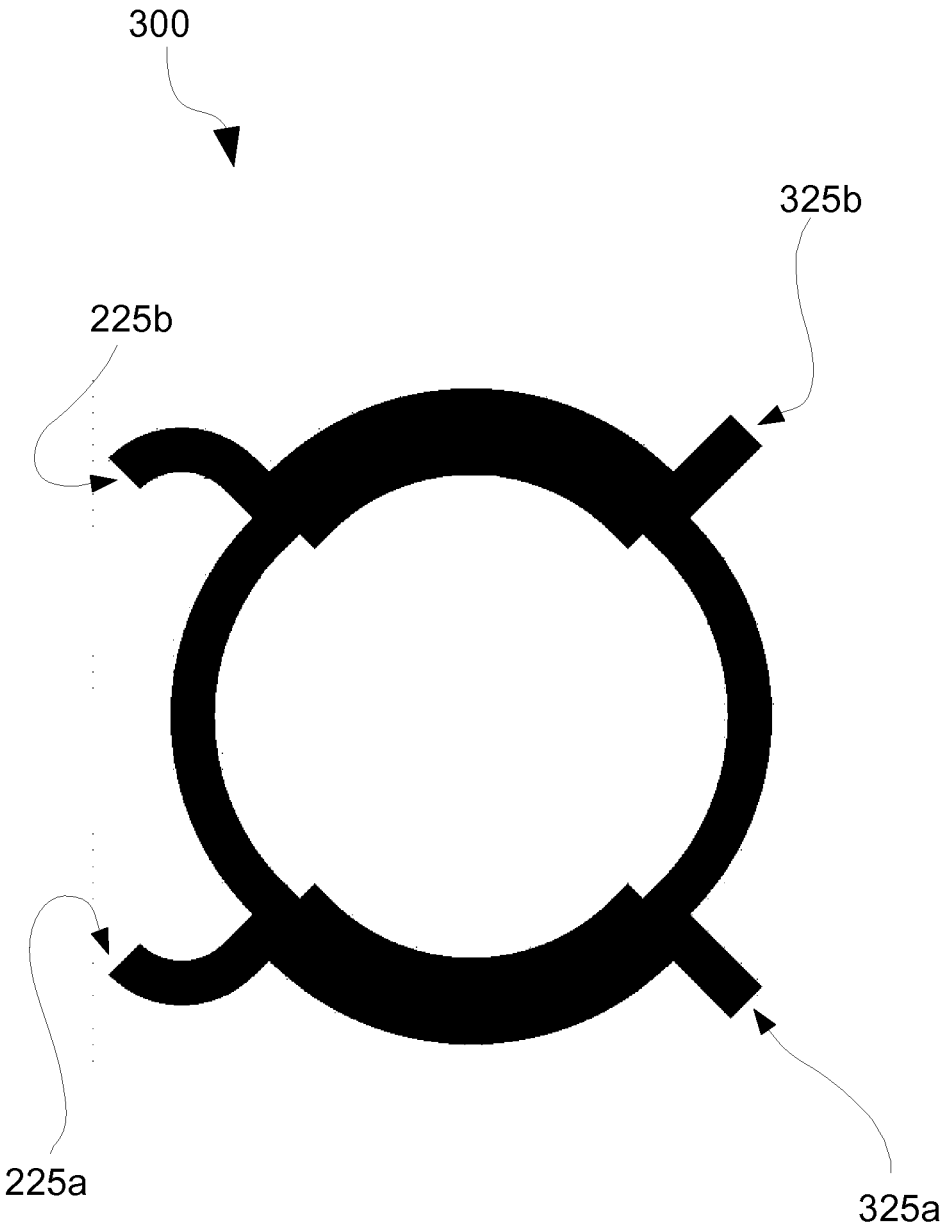
FIG. 3 illustrates an example of the hybrid 90 degrees coupler that can be used with the invention.

FIG. 3 shows an example of a component 300 that can be used to connect to the feeds 125*a* and 125*b*. The component 300 is a 90 degrees hybrid coupler that is used for example, for splitting RF signal in essentially half and outputting the split signals at a first port 225*a* and a second port 225*b* respectively. In reference to FIG. 2, it will be appreciated that the tracks 225*a* and 225*b* are shown in FIG. 3 as the first port and the second port respectively of the hybrid coupler 300. The signal at the first port 225*a* is 90 degrees phase shifted with respect to the signal at the second port 225*b*. The hybrid 300 also has a third port 325*a* and a fourth port 325*b* that are be connected to the rest of the circuit/components, for example, an amplifier, or a termination, or a detecting circuit, depending upon what the wireless device and the antenna are functionally supposed to do. The first port 225*a* can for example be connected to the first feed 125*a*, whereas the second port 225*b* connected to the second feed 125*b*. Hybrid couplers and their functionality is known in the field of art, hence not necessary in the discussion in this disclosure.

Figure 4:
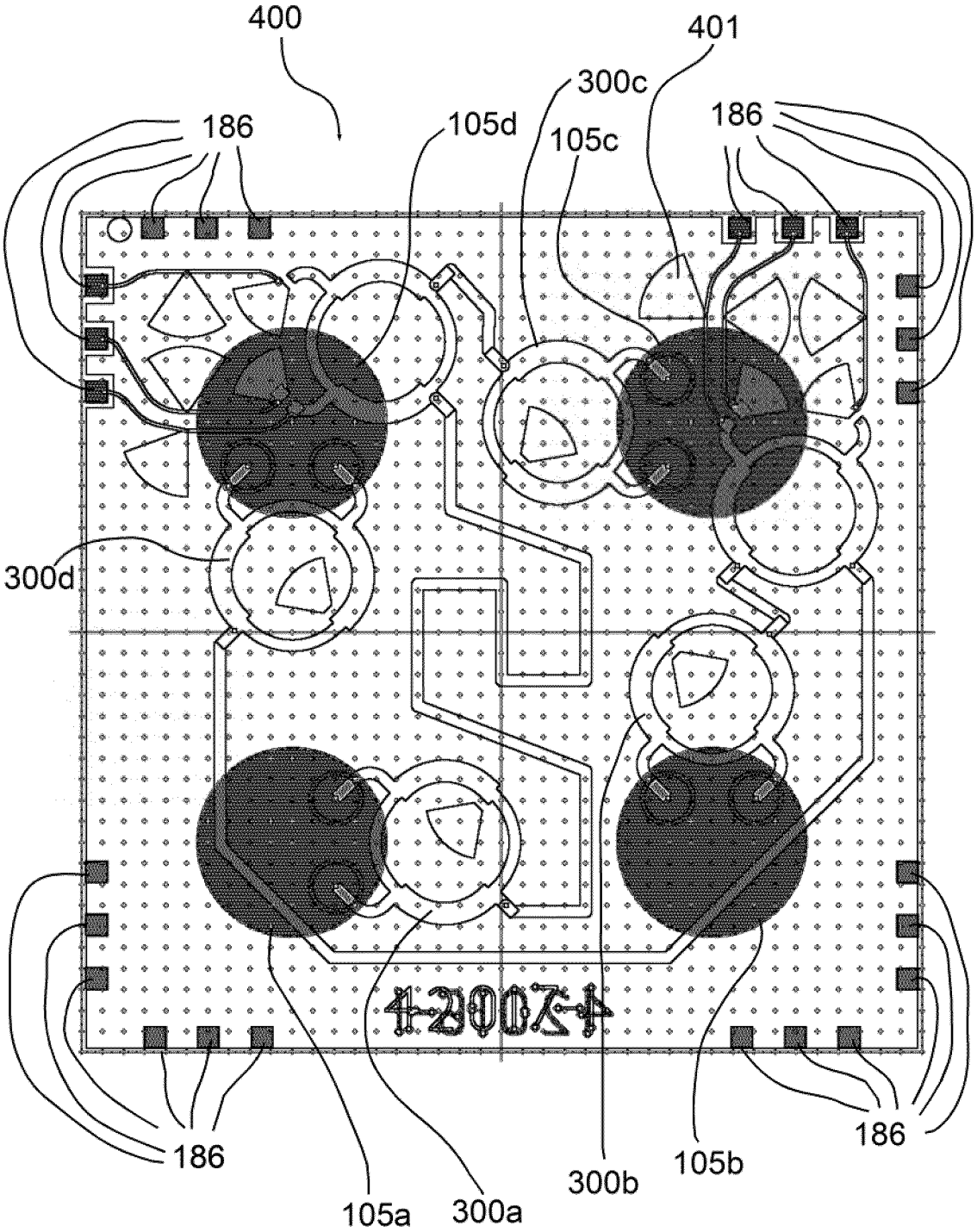
FIG. 4 illustrates a layout view of a sandwich type configuration that comprises four capacitively fed patches implemented according to the present teachings.

FIG. 4 shows a layout view 400 of an antenna arrangement comprising four patch antennas, 105*a-d*. The connection points or solder bumps 186 associated with the other profiles are also visible. At least some of these solder bumps 186 can for example be used for clamping the substrates together as shown previously. Furthermore, at least some of these solder bumps 186 may also be used for transferring signals between the substrates 101, 102 and the PCB or motherboard 180. For example, on the north side of the layout view, the three top-right pads are connected to the circuitry associated with the top-right patch 105*c*. Signals of this circuitry may be transferred to the PCB 180. The layout view 400 also shows quarter wavelength radial stubs, for example 401.

The skilled person will also appreciate that the embodiments explained in this disclosure can be combined with each other to realize an antenna arrangement according to specific requirements. Discussion of an embodiment separately does not mean that the embodiment cannot be used with the rest of the examples or other embodiments presented herein.

References herein to prior art do not constitute an admission that such publications constitute part of the common general knowledge in the art in any country. The word "comprise", and any variants thereof such as "comprising" and "comprises", as used in the present disclosure including accompanying claims, are used in an inclusive sense, i.e., so as not to preclude the presence or addition of further features, except where the context requires otherwise due to explicit language or necessary implication.

To summarize, the present teachings relate to an antenna arrangement comprising a first substrate. The first substrate comprises a first surface and a second surface. The first surface and the second surface are the opposite sides of the first substrate. The antenna arrangement also comprises a second substrate. The second substrate comprises a third surface and a fourth surface. The third surface and the fourth surface are the opposite sides of the second substrate. The antenna arrangement also comprises a patch antenna being realized in a first electrically conductive material attached to the first surface. The antenna arrangement further comprises a ground plane being realized in a second electrically conductive material attached to the second surface, and at least two feeds realized in a third electrically conductive material arranged to be attached at least partially to the fourth surface. The patch antenna is arranged with respect to the ground plane so as to form a resonant antenna. The first substrate and the second substrate are configured to be held in close proximity or in contact such that the third surface is facing the second surface, and each of said at least two feeds are having an individual corresponding opening in the ground plane for capacitively coupling each of said at least two feeds to the patch antenna. The footprint of each of said at least two feeds is smaller than footprint of its corresponding opening in the ground plane, thereby resulting in the footprint or periphery of each of the at least two feeds being essentially enclosed within the footprint or periphery its corresponding opening, in the antenna arrangement. The feeds are preferably orthogonal feeds. The footprint is preferably essentially circular, but it can also be of any other shape, such as square, rectangle, or any other polygon. The signal paths preferably extend radially outwards from the corresponding feeds. As previously discussed, the at least two feeds are end portions of their respective conductive tracks. The conductive tracks being used for feeding signal to and/or from the patch antenna.

In a preferred embodiment, at least one of the first substrate and the second substrate is a microwave substrate. More preferably, at least the first substrate is a microwave substrate. In another embodiment, the second substrate is a general purpose PCB.

In another embodiment, at least one of the first electrically conductive material, the second electrically conductive material, and the third electrically conductive material comprises metal, preferably silver. In other words, at least one of the conductive layers is realized using a metal-based paste, preferably silver, and further preferably using a thick film process.

In another embodiment, the third electrically conductive material is also used for forming at least, a plurality of tracks, pad, or routing on the fourth surface.

In yet another embodiment, at least some RF circuitry is mounted on the fourth surface using the conductive layer deposited on the fourth surface.

In another embodiment, the first and the fourth surface have a plurality of pads distributed along the periphery of the first surface and the second surface respectively. The first substrate and the second substrate are held in close proximity by soldering a plurality clamps, each clamp extending between a pad on the periphery of the first surface and to a corresponding pad on the periphery of the fourth surface. In other words, each clamp is attached by preferably soldering its one end to a pad on the first surface periphery and its second end soldered on a corresponding pad on the fourth surface periphery such that the first substrate and the second substrate are at least resiliently biased to be held in close proximity by the plurality of clamps. Alternatively or in combination, the first substrate and the second substrate are held in close proximity by an adhesive, the adhesive bonding at least some portion of the second surface and/or ground plane to at least some portion of the third surface.

According to an embodiment, the thickness of the first substrate is around 1 mm, and/or the thickness of the second substrate is around 0.63 mm. In the preferred embodiment, at least one of the first electrically conductive material, the second electrically conductive material, and the third electrically conductive material is attached using a thick-film process. Alternatively or in combination, at least one of the materials is attached using a thin-film process.

According to another embodiment, each of said at least two feeds are connected to a capacitive coupling pad, the capacitive coupling pad being realized in a fourth electrically conductive material at least partially attached to the third surface.

Preferably, the fourth electrically conductive material is attached to the third surface. According to yet another embodiment, each of said at least two feeds is connected to its respective capacitive coupling pad. The capacitive coupling pad of each of the at least two feeds is realized in the second electrically conductive material attached to the second surface. As it will be appreciated also from previous discussion, the each capacitive coupling pad is conductively isolated from the ground plane.

In yet an embodiment, the second substrate is replaced by a dielectric layer such that the antenna arrangement comprises, a first substrate comprising a first surface and a second surface, the first surface and the second surface being opposite sides of the first substrate. A patch antenna being realized in a first electrically conductive material attached to the first surface. A ground plane being realized in a second electrically conductive material attached to the second surface. A dielectric layer attached to at least some portion of the ground plane and/or the second surface. At least two feeds realized in a third electrically conductive material attached at least partially to the dielectric layer. The patch antenna being arranged with respect to the ground plane so as to form a resonant antenna, and each of said at least two feeds are having an individual corresponding opening in the ground plane for capacitively coupling each of said at least two feeds to the patch antenna. The footprint of each of said at least two feeds is preferably smaller than footprint of its corresponding opening in the ground plane, thereby resulting in the footprint or periphery of each of the at least two feeds being essentially enclosed within the footprint or periphery its corresponding opening, in the antenna arrangement. The footprint is preferably essentially circular, but it can also be of any other shape, such as square, rectangle, or formed as any other polygon. Similarly as in above discussion, the at least two feeds are end portions of their respective conductive tracks. The conductive tracks being used for feeding signal to and/or from the patch antenna.

The present teachings also relate to a wireless device comprising the antenna arrangement as hereby disclosed.

The invention claimed is:

1. An antenna arrangement comprising:

a first substrate comprising a first surface and a second surface;

the first surface and the second surface being opposite sides of the first substrate;

a second substrate comprising a third surface and a fourth surface, the third surface and the fourth surface being opposite sides of the second substrate;

a patch antenna being realized in a first electrically conductive material attached to the first surface;

a ground plane being realized in a second electrically conductive material attached to the second surface;

at least two feeds realized in a third electrically conductive material attached at least partially to the fourth surface;

wherein the patch antenna is arranged with respect to the ground plane so as to form a resonant antenna;

wherein the first substrate and the second substrate are configured to be held in close proximity or in contact such that the third surface is facing the second surface; and wherein each of said at least two feeds are having an individual corresponding opening in the ground plane for capacitively coupling each of said at least two feeds to the patch antenna, wherein footprint of each of said at least two feeds is smaller than footprint of its corresponding opening in the ground plane.

2. The antenna arrangement according to claim 1, wherein at least the first substrate is a microwave substrate.

3. The antenna arrangement according to claim 1, wherein at least one of the first electrically conductive material, the second electrically conductive material, and the third electrically conductive material comprises metal, preferably silver.

4. The antenna arrangement according to claim 1, wherein the third electrically conductive material is also used for forming at least, a plurality of tracks, pad, or routing on the fourth surface.

5. The antenna arrangement according to claim 1, wherein at least some RF circuitry is mounted on the fourth surface.

6. The antenna arrangement according to claim 4, wherein first and the fourth surface have a plurality of pads distributed along the periphery of the first surface and the second surface respectively, and the first substrate and the second substrate are held in close proximity by soldering a plurality clamps, each clamp extending between a pad on the periphery of the first surface and to a corresponding pad on the periphery of the fourth surface.

7. The antenna arrangement according to claim 4, wherein the first substrate and the second substrate are held in close proximity by an adhesive, the adhesive bonding at least some portion of at least one of the second surface and the ground plane to at least some portion of the third surface.

8. Antenna arrangement according to claim 1, wherein the thickness of the first substrate is around 1 mm.

9. The antenna arrangement according to claim 1, wherein the thickness of the second substrate is around 0.63 mm.

10. The antenna arrangement according to claim 1, wherein at least one of the first electrically conductive material, the second electrically conductive material, and the third electrically conductive material is attached using a thick-film process.

11. The antenna arrangement according to claim 1, wherein at least one of the first electrically conductive material, the second electrically conductive material, and the third electrically conductive material is attached using a thin-film process.

12. The antenna arrangement according to claim 1, wherein the second substrate is replaced by a dielectric layer attached to at least some portion of at least one of the ground plane and the second surface, and the at least two feeds are realized in the third electrically conductive material attached at least partially to the dielectric layer.

13. The antenna arrangement according to claim 1, wherein each of said at least two feeds are connected to a capacitive coupling pad, the capacitive coupling pad being realized in a fourth electrically conductive material at least partially attached to the third surface.

14. The antenna arrangement according to claim 1, wherein each of said at least two feeds is connected to its respective capacitive coupling pad, the capacitive coupling pad of each of the at least two feeds being realized in the second electrically conductive material attached to the second surface, and the capacitive coupling pad being conductively isolated from the ground plane.

15. A wireless unit comprising an antenna arrangement according to claim 1.

16. An antenna arrangement comprising:

a first substrate comprising a first surface and a second surface;

the first surface and the second surface being opposite sides of the first substrate;

a patch antenna being realized in a first electrically conductive material attached to the first surface;

a ground plane being realized in a second electrically conductive material attached to the second surface;

a dielectric layer attached to at least some portion of at least one of the ground plane and the second surface;

at least two feeds realized in a third electrically conductive material attached at least partially to the dielectric layer;

wherein the patch antenna is arranged with respect to the ground plane so as to form a resonant antenna; and wherein each of said at least two feeds are having an individual corresponding opening in the ground plane for capacitively coupling each of said at least two feeds to the patch antenna, wherein footprint of each of said at least two feeds is smaller than footprint of its corresponding opening in the ground plane.

* * * * *